US008672213B2

(12) United States Patent
Larsson et al.

(10) Patent No.: US 8,672,213 B2
(45) Date of Patent: Mar. 18, 2014

(54) FOOD CONTAINER AND METHOD FOR PRODUCING FOOD CONTAINER

(75) Inventors: Uno Larsson, Svenljunga (SE); Niklas Larsson, Askim (SE)

(73) Assignee: Uno Larsson, Svenjunga (SE)

( * ) Notice: Subject to any disclaimer, the term of this patent is extended or adjusted under 35 U.S.C. 154(b) by 572 days.

(21) Appl. No.: 12/995,827

(22) PCT Filed: Jun. 1, 2009

(86) PCT No.: PCT/SE2009/050635
§ 371 (c)(1),
(2), (4) Date: Dec. 2, 2010

(87) PCT Pub. No.: WO2009/148394
PCT Pub. Date: Dec. 10, 2009

(65) Prior Publication Data

US 2011/0079593 A1 Apr. 7, 2011

(30) Foreign Application Priority Data

Jun. 2, 2008 (SE) ..... 0801298

(51) Int. Cl.
*B65D 3/06* (2006.01)
*B65D 3/24* (2006.01)

(52) U.S. Cl.
USPC ..... 229/4.5; 229/120.18; 229/400; 229/405; 229/902

(58) Field of Classification Search
USPC ..... 229/4.5, 120.08, 120.18, 400, 402, 405, 229/902, 906; 426/115, 119, 120
See application file for complete search history.

(56) References Cited

U.S. PATENT DOCUMENTS

| | | | | | |
|---|---|---|---|---|---|
| 952,365 | A | | 3/1910 | Sharon | |
| 995,343 | A | * | 6/1911 | Goodale | 229/400 |
| 1,020,617 | A | * | 3/1912 | Matthews | 229/402 |
| 1,121,259 | A | * | 12/1914 | Klin | 229/402 |
| 1,800,534 | A | | 4/1931 | Jannings | |
| 2,002,215 | A | * | 5/1935 | Blitz | 229/402 |

(Continued)

FOREIGN PATENT DOCUMENTS

NL 1020475 C1 1/2004

OTHER PUBLICATIONS

International Search Report (dated Sep. 17, 2009) and Written Opinion (dated Sep. 17, 2009).

(Continued)

*Primary Examiner* — Gary Elkins
(74) *Attorney, Agent, or Firm* — Jeffrey S. Melcher; Manellia Selter PLLC

(57) ABSTRACT

A food container having at least two open cone shaped spaces is formed from a sheet folded along three folding lines. The first and second folding lines intersect at a point near or in a point along a center line of the sheet to allow upper surfaces of the sheet on each side of the folding lines to be moved against each other. The third folding line extends transversally in relation to the center line and intersects the first and second folding lines substantially at the point. The third folding line allows folding of the sheet on each side of the third folding to move the surfaces on the under side of the sheet against each other thereby forming two open cones when parts respectively on each side of the third folding line are brought against each other.

17 Claims, 4 Drawing Sheets

(56) References Cited

U.S. PATENT DOCUMENTS

| | | | | |
|---|---|---|---|---|
| 2,967,609 | A * | 1/1961 | Gabbard | 229/400 |
| 5,137,210 | A * | 8/1992 | Hibbs | 229/120.18 |
| 6,119,930 | A | 9/2000 | Lunstra | |
| 6,558,652 | B2 | 5/2003 | Takata | |
| 7,140,532 | B2 | 11/2006 | Holt | |
| 7,273,162 | B2 | 9/2007 | Baker | |
| 2003/0015580 | A1 * | 1/2003 | Pellati | 229/120.18 |

OTHER PUBLICATIONS

Bjorklind, Theresa et al., "Bigverktygets inverkan pa kartong", Dissertation at Orebro University, http://www.oru.se/oru/upload/Instirutioner/Teknik/Dokument/Exiobb%202003/Oru-Te-EXM080-M105-02.pdf.

Supplementary European Search Report (completed Sep. 7, 2011) for corresponding European application.

* cited by examiner

FOOD CONTAINER AND METHOD FOR PRODUCING FOOD CONTAINER

CROSS-REFERENCE TO RELATED APPLICATIONS

This application is a national stage entry under 35 U.S.C. 371 of International Application No. PCT/SE2009/050635, filed 1 Jun. 2009, designating the United States. This application claims foreign priority under 35 U.S.C. 119 and 365 to Swedish Patent Application No. 0801298-1, filed 2 Jun. 2008. The complete contents of these applications are incorporated herein by reference.

TECHNICAL FIELD

This invention relates to a blank of board to produce disposable container having two cones for serving food from fast food stands and also a folded disposable container produced from said blank.

The expression "container having two cones" is to be understood as a container having two cones positioned next to each other, which are produced by means of folding said blank.

PRIOR ART

In connection with selling of fast food and similarly relatively small pieces of food, such as hamburgers and fish burgers (both without bread), chips, kebab, sushi and "fish and chips", from hamburger and hot dog stand/bars, etc to customers to be consumed at the place, the customers normally will have it served on a disposable plate/tray of board or similar, see for example U.S. Pat. No. 6,558,652. Many people find this kind of serving utensils uncomfortable, since they are relatively unstable and has to be balanced (at least partly), within the palm of the hand. In cases where some kind of gravy is included, this will either be served directly on top of the pieces of food or alternatively the client will have it served in the other hand in a can-like packaging with a tearable lid or in foil sachets, which are opened by tearing. The need of using both hands lead to problems for the customer, who needs to find an appropriate place to put the food in order to open the packaging with the gravy like extras. Furthermore that kind of portion packaging implies costly extras in itself.

Many different kinds of disposable containers have been suggested in order to minimize the above disadvantages, inter alia by the use of more longish, trough formed disposable containers, which provide the ability to grip around the container, which is known e.g. from U.S. Pat. No. 6,119,930 and U.S. Pat. No. 7,140,532. From U.S. Pat. No. 7,273,162 it is known a certain kind of longish disposable container having a cone shape which implies that a larger opening is being formed in comparison to if the trough is in a form of the parallelepiped, which makes the handling easier regarding certain aspects. However, none of these known containers seems to solve the problem in a satisfactory manner, especially not regarding costs.

SUMMARY OF THE INVENTION

The object with the invention is to achieve an open, disposable container, which is cone shaped, in order to provide a large opening, but of a double cone type, preferably made in board, within which the customer for example can have the dish in one of the cones and extras in the other and which is easy to handle for the customer with one hand. Furthermore the blank preferably should be cheap to produce, not occupy much space during storage and be simple for the clerk to create a double cone container.

In accordance with the invention these objects are achieved by means of what is defined in the independent claims.

A blank that is made in this manner, for instance of board, occupies very little storage space at the sales place for fast food. The blank is cheap and simple to produce by pressing of the folding lines, and possibly punching. Folding lines are (mostly straight lined, at least partly) furrow shaped grooves which facilitates folding of the board. Folding or grooving is performed with pressing tools, bars (folding rulers) or profiled rolls (grooving wheels). Easy handling for the staff at the fast food stands and the customer respectively is achieved thanks to making it possible to use a natural pinching movement with the thumb and for example the middle finger against the third folding line from the underside of the blank, whereby the double cone is formed automatically. Thanks to its double cone shape the container is easy and comfortable to hold.

The blank can be round or oval, but preferably it is substantially rectangular, having the third folding line extending transversally across the blank perpendicularly between the long sides of the rectangle. Thereby the sheet formed blank is used in a very economical way. The expression "board" is here used as a generalizing expression not only to relate to stiff paper or thin board, conventionally produced from fibers for paper production, but also substitute materials for such qualities, preferable such which are classified as environmentally friendly. It may be an advantage to produce the sheet formed blank as to be eatable, for example by mainly containing flour and/or starch (for example from maize or oat) and other eatable ingredients to obtain a sufficiently stiff and formable sheet.

It is convenient that the sheet has rounded short sides, which for instance may be achieved by punching. By taking away the corners of the sheet, the risk for unintentionally hooking into an upwardly extending corner of the assembled double cone container is reduced.

Preferably there is formed a U-shaped area in connection with an edge of the sheet, which is delimited by means of perforation, such that the mainly U-shaped area easily can be taken out from the sheet and then in an inverted position be brought down onto the area of the folded sheet, where the two parts of the third folding line contacts each other, after folding of the sheet, at the upper end thereof.

Preferably the sheet is basically of the size A4. The use of a standard size A4 may in some cases drastically lower the production costs.

In order not to risk that any components of the food/food pieces or the gravy like extras is leaking through the underside of the sheet, it is preferable that the sheet has an upper side which is substantially impermeable in relation to food stuffs. In a preferred embodiment according to the invention the board is coated liquid board.

According to one embodiment the third folding line is arrange with a means for attachment, for example string of adhering adhesive, protected by a tearing foil. In this manner is easy to arrange for having the double cone container to maintain its form after bringing together the two parts of the third folding line in contact with each other. In such a case it is appropriate that the adhesive is chosen from a group of adhesives, which is acceptable to have in contact with food stuff.

From the above it is evident that the blank can be sold in bundles of board sheets of A4 size and that the sales person folds disposable container of double cone type in connection with placing food that has been ordered by the customer.

However, an attractive alternative for the serving staff is to have the disposable double cone type containers of the blank in connection with production, which preferably are given the form of a rectangular circle sector, which can be packed in bundles. It might appear less time consuming to grip a pre-folded disposable container than to have to fold it, even if it is easily and quickly achieved. When the blank is made from coated liquid board, it is possible to produce assembled disposable containers having contacting portions of the third folding lines adhering each other by means of heat, which makes the top layer of the coated liquid board adhesive.

BRIEF DESCRIPTION OF THE ATTACHED FIGURES

In the following the invention will be described in more detail with reference to the preferred embodiments and the enclosed figures.

DETAILED DESCRIPTION OF PREFERRED EMBODIMENTS

Figure 1A:
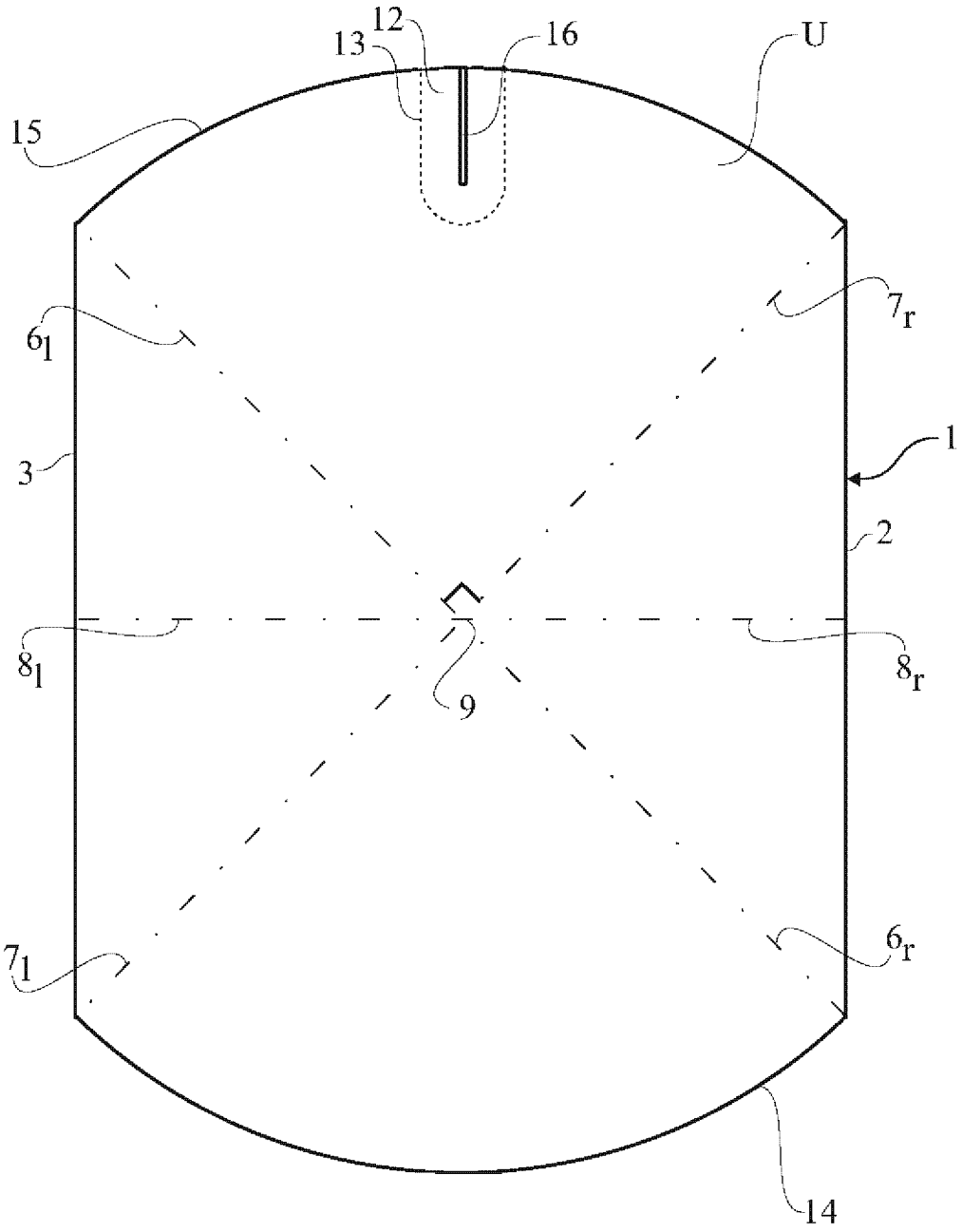
FIG. 1 is a planar view of a preferred embodiment of a blank of board according to the invention to achieve a disposable container of double cone type by means of folding of the blank to a container having two next to each other positioned cones, which are relatively wide.
Figure 1B:
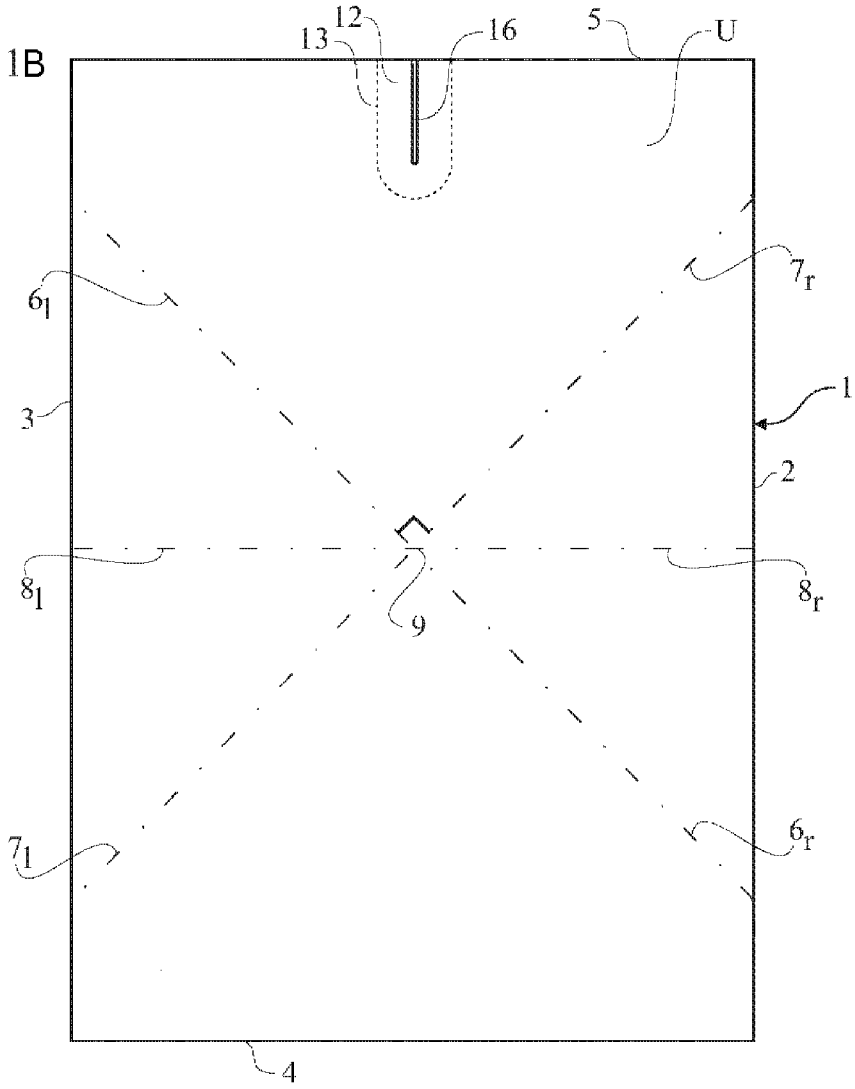

FIG. 1 is a planar view of the preferred embodiment of a blank 1 according to the invention to achieve a disposable container of double cone type having large openings, by means of folding of the blank to a container, which has two cones A, B which are positioned next each other and being relatively wide. The blank is sheet formed and has an upper side U and a underside D. The blank may be round or oval, but preferably the blank as is shown in FIG. 1, is mainly rectangular and therefore has two long sides 2,3 and two short sides 4,5.

The blank is arranged with a first and a second folding line 6,7 respectively, which are symmetrically arranged and extend from one long side to the other, which intersect each other substantially perpendicularly in a point 9 that is substantially positioned on the middle of the blank 1. The folding lines are according to definition straight lined, notch formed grooves which are achieved by means of pressing tools, straight lined bars (folding rulers) profiled rolls (grooving wheels) and they facilitate or makes it possible to fold the board. Further information regarding folding of board may be found in the dissertation by Therese Björklind and Anna Jansson, Örebro University, "Bigverktygets inverkan på kartong"
http://www. oru.se/ oru/ upload/ Institutioner/ Teknik/Dokument/ Exjobb% 202003/ Oru-Te- EXM080-M105-02.pdf.

The first and the second folding line 6 and 7 facilitate folding of surface areas, to be folded against each other, which are positioned on opposing sides of each respective folding line. Further the blank 1 is arranged with a third folding line 8, which extends perpendicularly in relation to a centre line L which extends in the longitudinal direction between the long sides 2, 3 and which forms bisectories to the angle between the two folding lines 6 and 7, to facilitate folding of surface areas, to be folded against each other, which are positioned on the underside on each side of the third folding line. Thereby the third folding line 8 will be divided into two halves in a first part 8*r* and a second part 8*l*, which by means of applying a force against them from the lower side D of the blank 1 will move them into contact with each other to delimit two wide cones A, B on each side of said contacting portions. The index r and l are used here to refer to a positioning to the right and to the left respectively.

A blank that has been formed in this manner, made of board, is planar and will occupy a small space in connection with storing in a kitchen. The blank is cheap and easy to produce from board by means of pressing folding line 6, 7 and 8. Preferably the folding lines 6 and 7 are pressed in from above, but the folding line 8 from below. Easy handling is obtained for the staff of the fast food stands by facilitating gripping/pinching from the underside D of the blank with a thumb and e.g. middle finger of one hand onto the third folding line 8, whereby the double cone A, B will be formed automatically.

Figure 2:
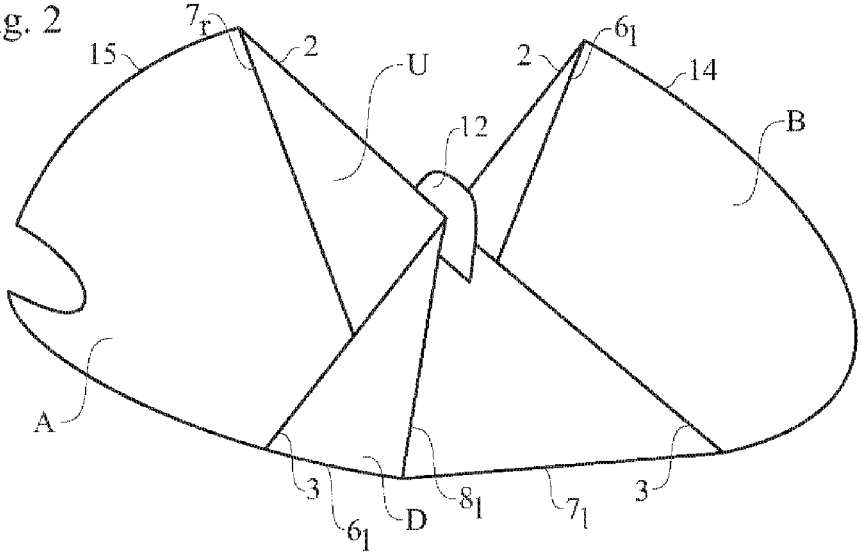
FIG. 2 is a perspective view of a disposable container of double cone type achieved by means folding of the blank according to FIG. 1.

Preferably there is shaped substantially U-formed area 12 in one of the short sides 5 of the blank, which is detachable by means of a perforation 13. The U-shaped area 12 between the legs of the U presents a punched slit 16, which separates the legs. Thanks to the perforation 13 the mainly U-formed area 12 may easily be taken away from the blank and then in an inverted manner moved down onto the blank as a clamp, in an area where the two parts 8*r*, 8*l* of the third folding line contact each other at the upper end (after folding) of the blank. FIG. 2 shows a perspective view of a disposable container of double cone type, which is produced from the blank 1 of board shown in FIG. 1 and presents two cone parts kept against each other by means of the ripped out clamp 12, which presses the two contacting ends of the third folding line against each other.

The blank 1 may be round or oval, but preferably the blank is substantially rectangular, having the third folding line extending transversally over the blank perpendicularly between the long sides 2, 3 of the blank. Thereby the board material is used in an economical manner.

It is preferred to have the rectangular blank arranged with rounded short sides 14, 15, which preferably are achieved by means of punching of the blank 1. By eliminating the corners of the blank, the risk is reduced to unintentionally hook into an upwardly extending corner of the assembled double cone container. Furthermore the disposable container will obtain a more appealing appearance.

Preferably the blank is basically of size A4. The use of a standard size A4 may lower the production costs. When the first and the second folding lines 6 and 7 respectively, intersect each other perpendicularly in an A4 sheet, the distance from the point of intersection line to the short sides 4, 5 of the sheet will have the same length as the length of the folding line portions 6*r*, 6*l*, 7*r* and 7*l* between the point of intersection 9 and those points where the folding lines 6, 7 reaches to the long sides of the sheets.

Figure 4:
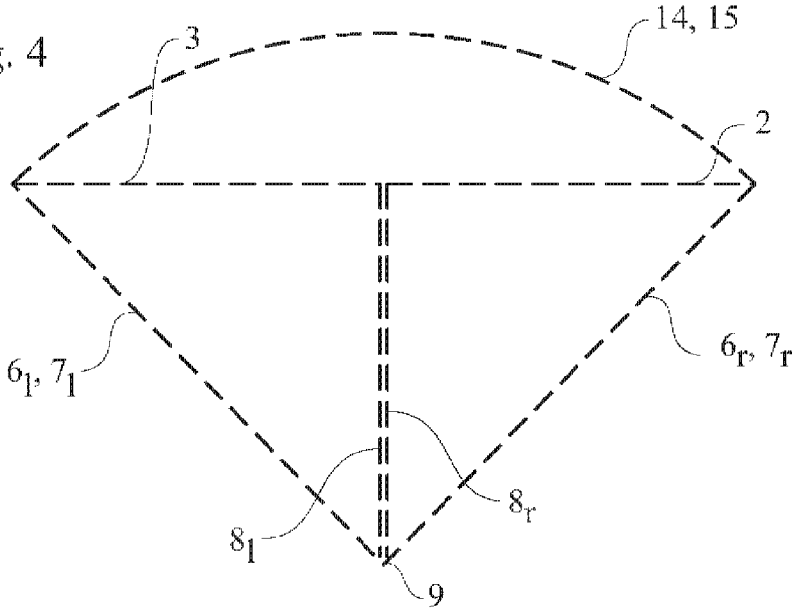
FIG. 4 is a side view of flattened disposable container produced from the blank according to FIG. 1.

In order not to risk that for example some components of the food/food pieces or gravy like extras will leek to the underside of the blank, it is appropriate that the upper side of the sheet is substantially impermeable to food stuff. An appropriate board material is liquid board, which also provides the advantage that against each other positioned portions 8*r* and 8*l* of the third folding line may be adhered to each other by means of heat, which will make the surface layer of the liquid board adhesive. Such an assembly is preferably performed factory wise and thereby ready to use disposable containers of double cone type will be obtained. These may preferably be flattened from the side of the short sides 14, 15 and under condition that the first and the second folding lines 6, 7 respectively intersect each other perpendicularly the disposable container will then attain the form of a rectangular circle sector, as is shown in FIG. 4 and may be packed bundle wise.

If desired it is of course possible, during the production of assemble disposable containers of double cone type, to use another board material than liquid board, whereby for example one may apply hot melt along the portions 8*r* and 8*l* of the third folding line, which are to contact each other, to achieve adhering and to keep it in contact until the adhesive has obtained sufficient strength. Flattening and packaging may be performed as above.

Figure 3:
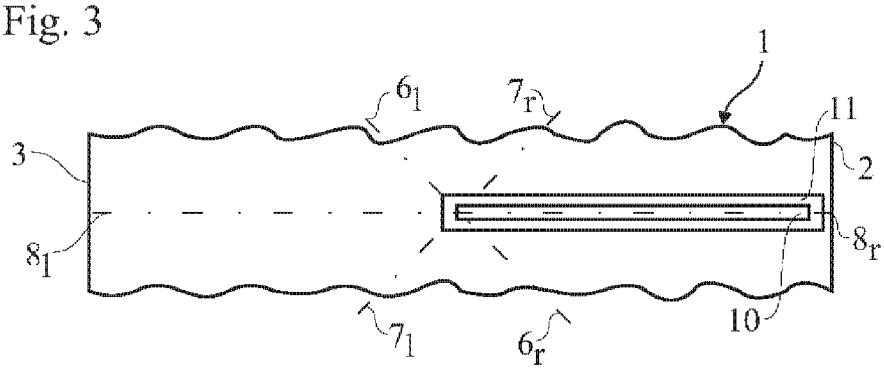
FIG. 3 is a part of the mid portion of the blank shown in FIG. 1, in an alternative embodiment presenting a string of adhering adhesive, protected by a tearing foil and positioned along a portion of the transversal folding line of the blank.

As is shown in FIG. 3, in an alternative the portion 8*r* (and/or 8*l*) of the third folding line is arranged with an adhesive, e.g. a string of adhering adhesive, protected by a tearing off foil 11. In this manner it is easy to arrange for having the double cone container to keep its form after bringing the two portions 8*r* and 8*l* of the third folding line in contact with each other. In such an alternative the adhesive preferably is chosen from a group of the adhesive, which are acceptable to be in contact with food stuff. In the embodiment shown in FIG. 3 the tear off foil 11 is transparent, such that the string of adhesive is visible through it, but of course this is not a necessity. After taking away the foil 12, the two parts of the third folding line will be attached to each other when pressed into contact.

From the above it is evident that the blank 1 may be sold in bundles of board sheets of size A4 and that the serving staff fold the disposable containers of double cone type in connection with putting the ordered food into it. An attractive alternative for the staff, however, is to arrange for having the blanks folded already in connection with production, to form disposable containers of double cone type, which in a flattened shape seen from the short sides 4, 5 of the blank 1, have the form of a rectangular circular sector and may be packed in bundles. It may appear less time consuming to fetch assembled disposable container than to personally fold it, even if it is easily and quickly obtained. If desired the circle sector formed under side of the blank 1, between the folding lines 6*r* and 7*l* and/or between 7*r* and 6*l* which provide the outer surface of the ready to use disposable container, may be provided with printed advertisement.

Figure 5:
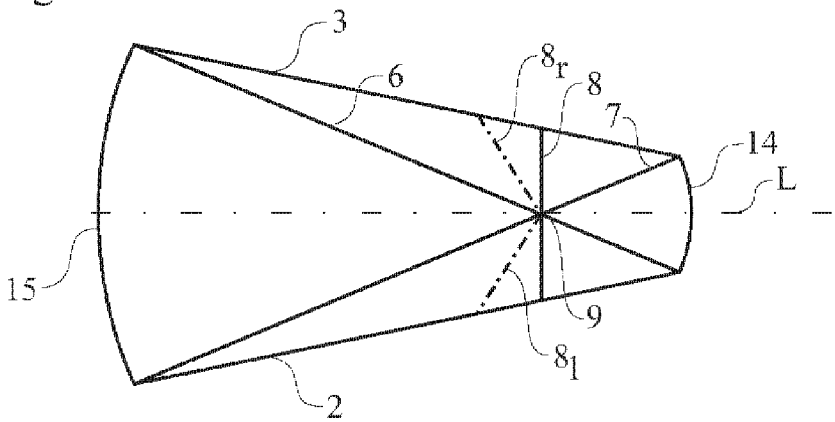
FIG. 5 is a schematic planar view from above of an embodiment of a sheet formed blank according to the invention to achieve a disposable container of double cone type with different sizes of the two cones to be shaped.

In FIG. 5 there is shown a planar view of a sheet formed blank according to the invention whereby a sheet 1 of a non-rectangular form is used, which has straight lined, converging long sides 2, 3. The extension of one short side 15 in this embodiment is substantially larger than the extension of the other short side 14. According to the same principle as shown in FIG. 1 there is a first and a second folding lines 6, 7 arranged from one corner to another such that they intersect each other in a point 9 along the centre line L of the sheet, whereby the intersection point 9 will be positioned closer to the smaller short side 14 than the longer short side 15. Also in accordance with the principle above there is arranged a third folding line transversally in relation to the centre line L, such that it intersects in the same point 9, as the other two folding lines 6, 7. When this blank is being folded, in accordance with what is described above, there will be formed a first cone shaped container (at the short side 15) which is substantially larger than the other cone shaped container (at the short side 14). This kind of embodiment may be beneficial in connection with having more substantial food stuff in the larger container (e.g. chips) whereas having smaller amount of another food stuff (e.g. ketchup) in the smaller container. By means of the dotted folding lines 8*l*' and 8*r*' respectively there is shown that the third folding line in an alternative embodiment may be provided by having two in relation to each other angled part folding lines 8*l*', 8*r*', which meet each other in the intersecting point 9. According to such an embodiment (i.e. without folding line 8) the form of the larger cone will be slightly less and the size of the smaller cone slightly larger, in comparison with having a straight lined, transversal folding line 8. Also embodiment disclosing several alternative folding lines (for example both 8 and 8') are of course feasible, if it is desired to offer the client the possibility of having variable sizes of the double cones A, B.

Figure 6:
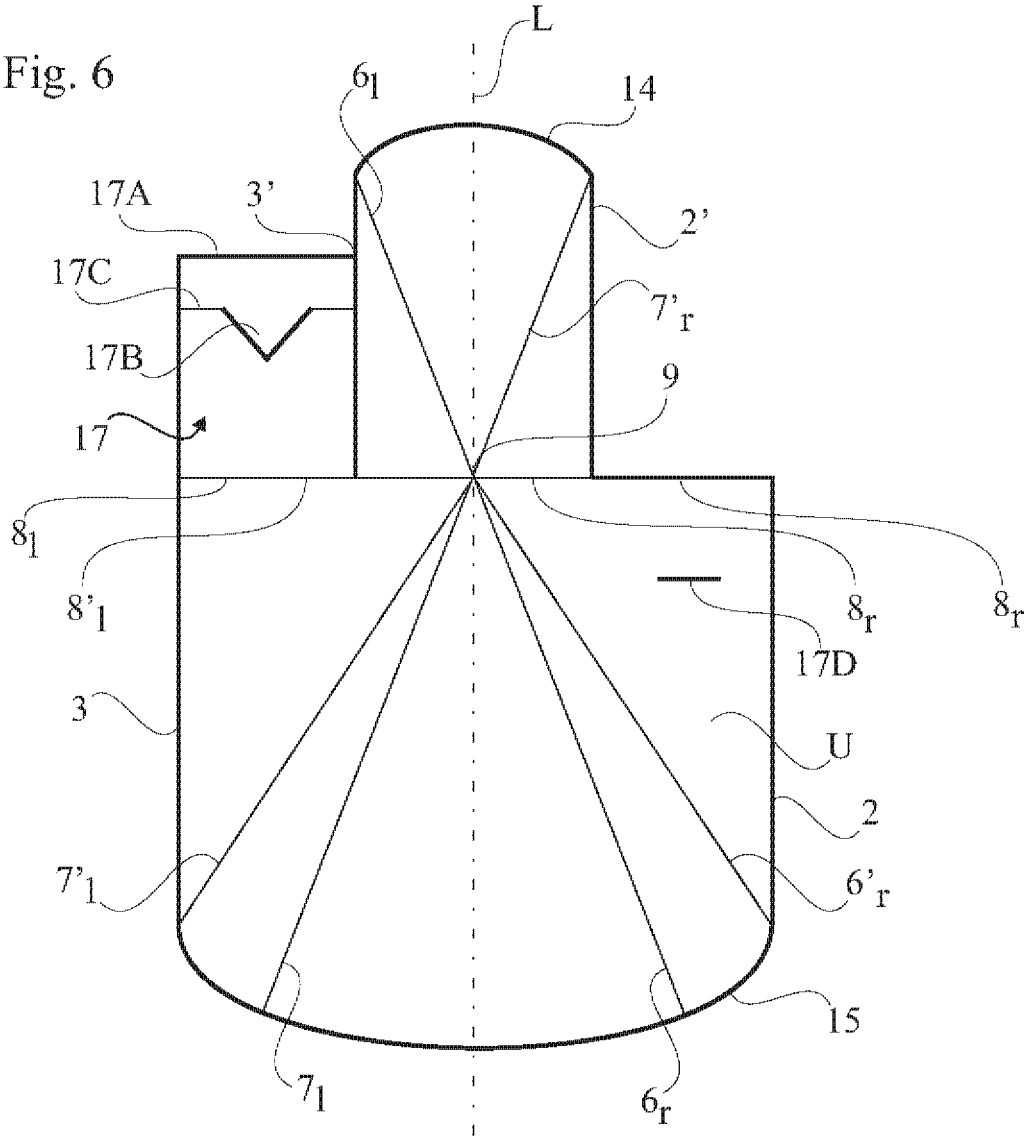
FIG. 6 shows a further embodiment in accordance with the invention.

In FIG. 6 there is shown a view from above of a further embodiment according to the invention. Also in this embodiment (like FIG. 5) there is shown a container having a smaller cone and a bigger cone. The main difference regarding FIG. 5 is that the attachment device 17 in this embodiment is integrated with the sheet 1, and in contrast to the embodiment shown in FIG. 1 the attachment device 17 will remain integrated with the sheet 1, also during utilization. Many of the main principles of what has been shown and described above remain the same, e.g. having symmetrically positioned folding lines 6, 7, 8, which intersect in a common point 9. The folding principle is also the same to achieve the cones. However, in FIG. 6 it is shown that the upper portion, that will form the smaller cone, has a baseline $\mathbf{8}_l'$, $\mathbf{8}_r'$ that is about half the length of the totality of the same lines $\mathbf{8}_l$, $\mathbf{8}_r$ for the larger cone. At one side this is achieved by simply eliminating sheet material (e.g. by punching) next to the sheet material that will form the smaller cone. On the other side the corresponding sheet material is partly left, i.e. attached to the folding line $\mathbf{8}_l$, to form said attachment device 17. Accordingly the attachment device 17 has its base along the outer portion of the left hand side folding line $\mathbf{8}_l$ and protrudes parallelly with the sheet material that will form the smaller cone. The upper edge 17A is positioned closer to the folding line $\mathbf{8}_l$ than the curved upper edge 14 that will form a part of the smaller cone. Further it is shown that there is punched into the attachment device 17 a V-shaped tab device 17B and a further folding line 17C connecting the ends of the V-device 17B, positioned substantially parallel with the base folding line $\mathbf{8}_l$. The V 17B is positioned such that the apex points against the baseline $\mathbf{8}_l$ and substantially centrally in relation to a longitudinal centreline of the attachment device 17, but closer to the upper edge 17A than the baseline $\mathbf{8}_l$. Within the sheet material forming the larger cone there is a slit 17D arranged to interact with the V-device 17B of the attachment device 17. Accordingly when the cones A, B are formed the transversal folding lines $\mathbf{8}_l$, $\mathbf{8}_r$ are moved into contact with each other and the attachment device 17 is then flipped into contact with the backside of the material of the larger cone and the V-device 17B pushed into the slit 17D, whereafter safe assembly of the container is achieved, forming a smaller cone and a larger cone. Further it can be seen that there are arranged two further folding lines $\mathbf{7}'_r$, $\mathbf{6}'_r$ within the sheet forming the larger cone, which extra folding lines in some applications are beneficial due to forming a cone without any very sharp corners. It is evident that this principle may be applied in all of the other shown embodiments.

The invention is not limited of what is described above but may be varied within the scope of the appended claims. Hence, it is evident that the skilled person may choose from a wide variation of sheet formed blanks, which can fulfill different kind of needs and desires. Board, coated or non-coated, treated or non-treated is regarding many different aspects, not at least from an environmental aspect, a raw material which is suitable for many different kind of applications, but also different forms of polymer material may fulfill the same kind of functionality regarding most aspects, and in certain applications may indeed also be better than a board product. In the same manner it is evident that the grammage of the sheet formed material can vary within wide ranges, depending on needs and desires. Furthermore it is evident that also curved folding lines may be used. Moreover it is evident that many other forms of adhering devices may be used to keep the double cone together, as also that in many cases there may be no need at all for any device to keep it together, since the gripping of the container according to the invention is clearly advantageous from an ergonomic view point and therefore not really tiring (in contrast to many other kind of containers). According to a modification of the invention its final form, i.e. as double cone, may be used in form stable material, e.g. in stiff maize bread, since its shape is beneficial from an ergonomic view point, e.g. in order to replace trough formed shells which are used for taco eating. Hereby the basic principles of the invention are used for the forming and thereafter followed by baking.

The invention claimed is:

1. A food container comprising at least two open cone shaped spaces, wherein the container is formed from a sheet, said sheet having an upper side and an under side and being provided with a number of folding lines arranged to facilitate formation of said food container with at least two open cone shaped spaces, wherein said sheet comprises:

a centre line;

a first folding line;

a second folding line, which intersect near or in a point along said centre line extending near, or in, the middle of said sheet to allow surfaces of said upper side on each side of said folding lines to be moved against each other; and a third folding line, which extends transversally in relation to said centre line and which intersects said first and second folding lines at least substantially in said point arranged to facilitate folding along said third folding line of portions on each side thereof to move their surfaces of said under side against each other, wherein the third folding line is divided mainly on the middle into a first part and a second part arranged to form two open cones on each side of said third folding line when said first part and said second part are brought against each other, wherein said sheet is provided with an integrated portion or means for holding together of the two cones.

2. A food container according to claim 1, wherein said first and second folding lines are symmetrically arranged in relation to the centre line, that said first part and said second part are arranged to extend to present the same angle and symmetrically in relation to said centre line.

3. A food container according to claim 1, wherein the sheet comprises longer sides and shorter sides, and wherein said shorter sides and said longer sides together form upper edges of each one of said cones.

4. A food container according to claim 3, wherein said sheet has at least one convexly curved short side.

5. A food container according to claim 3, wherein said sheet is rectangular.

6. A food container according to claim 1, wherein said first and second folding lines intersect each other substantially perpendicularly in said point and that said third folding line form a bisector of to the angle between the other folding lines.

7. A food container according to claim 1, wherein said sheet is substantially impermeable in relation to food items.

8. A food container according to claim 1, wherein a mainly U-shaped area is arranged adjacent an edge of said sheet by means of perforations, arranged to facilitate removal from the sheet and to be positioned onto an area of the folded sheet for holding together the two parts of the third folding line.

9. A food container according to claim 1, wherein said third folding line at least partly is arranged with an adhesive.

10. A food container according to claim 2, wherein said third folding line extends substantially perpendicularly in relation to the centre line.

11. A food container according to claim 3, wherein said sheet has at least two convexly curved short sides.

12. A food container according to claim 3, wherein said sheet is in the size of A4.

13. A food container according to claim 1, wherein a mainly U-shaped area is arranged adjacent an edge of said sheet by means of perforations, arranged to facilitate removal from the sheet and to be positioned onto an area of the folded sheet for holding together the two parts of the third folding line at the upper portion of the folded sheet.

14. A food container according to claim 1, wherein said third folding line at least partly is arranged with an adhesive in a form of a string.

15. A food container according to claim 1, wherein said third folding line at least partly is arranged with an adhesive in a form of a string wherein said string is protected by a foil.

16. A food container comprising at least two open cone shaped spaces, wherein the container is formed from a sheet, said sheet having an upper side and an under side and being provided with a number of folding lines arranged to facilitate formation of said food container with at least two open cone shaped spaces, wherein said sheet comprises:

a centre line;

a first folding line;

a second folding line, which intersect near or in a point along said centre line extending near, or in, the middle of said sheet to allow surfaces of said upper side on each side of said folding lines to be moved against each other; and a third folding line, which extends transversally in relation to said centre line and which intersects said first and second folding lines at least substantially in said point arranged to facilitate folding along said third folding line of portions on each side thereof to move their surfaces of said under side against each other, wherein the third folding line is divided mainly on the middle into a first part and a second part arranged to form two open cones on each side of said third folding line when said first part and said second part are brought against each other, further comprising two cones produced from said sheet, wherein an attachment device is used for holding together the two cone shaped spaces.

17. A food container comprising at least two open cone shaped spaces, wherein the container is formed from a sheet, said sheet having an upper side and an under side and being provided with a number of folding lines arranged to facilitate formation of said food container with at least two open cone shaped spaces, wherein said sheet comprises:

a centre line;

a first folding line;

a second folding line, which intersect near or in a point along said centre line extending near, or in, the middle of said sheet to allow surfaces of said upper side on each side of said folding lines to be moved against each other; and a third folding line, which extends transversally in relation to said centre line and which intersects said first and second folding lines at least substantially in said point arranged to facilitate folding along said third folding line of portions on each side thereof to move their surfaces of said under side against each other, wherein the third folding line is divided mainly on the middle into a first part and a second part arranged to form two open cones on each side of said third folding line when said first part and said second part are brought against each other, further comprising forming two cones produced from said sheet, wherein said upper side includes meltable material and presenting contacting parts of the third folding line added to each other by means of heat.

* * * * *